US007140613B2

(12) United States Patent
Glikmann

(10) Patent No.: US 7,140,613 B2
(45) Date of Patent: Nov. 28, 2006

(54) SCRAMBLED WORD GAME

(76) Inventor: Kevin L. Glikmann, 16607 Calneva Dr., Encino, CA (US) 91436

( * ) Notice: Subject to any disclaimer, the term of this patent is extended or adjusted under 35 U.S.C. 154(b) by 0 days.

(21) Appl. No.: 10/217,194

(22) Filed: Aug. 9, 2002

(65) Prior Publication Data

US 2005/0073097 A1 Apr. 7, 2005

(51) Int. Cl.
*A63F 1/00* (2006.01)

(52) U.S. Cl. ..... 273/272; 273/429

(58) Field of Classification Search ..... 273/272, 273/429; 434/160, 167, 171, 172
See application file for complete search history.

(56) References Cited

U.S. PATENT DOCUMENTS 3,195,895 A * 7/1965 Kropinski ..... 273/240
4,923,199 A * 5/1990 Hahn ..... 273/299
5,145,183 A * 9/1992 Gates ..... 273/240
5,207,435 A * 5/1993 Tanner ..... 273/429
5,586,765 A * 12/1996 Lackey ..... 273/299
5,788,238 A * 8/1998 LeBriton et al. ..... 273/272
5,906,492 A * 5/1999 Putterman
6,454,262 B1 * 9/2002 Wilt et al. ..... 273/243

* cited by examiner

*Primary Examiner*—William M. Pierce
(74) *Attorney, Agent, or Firm*—W. Edward Johansen

(57) ABSTRACT

A scrambled word game includes a plurality of cards forming a card set. Each card has printed thereon a scrambled version of a word. The scrambled word game also includes a plurality of blank letter tiles for each player and a plurality of blank Word-Sticks of varying word length. Each player forms as many permutated words from the displayed scrambled word and writes each of the permutated words on one of the blank Word-Sticks.

1 Claim, 8 Drawing Sheets

39

E D G A L N I

3 Letters: Find 20 out of 39 words.
4 Letters: Find 20 out of 60 words.
5 Letters: Find 20 out of 33 words.
6 Letters: Find all 16 words.
7 Letters: Find all 3 words.

Fig 10.

39

AGE AID AIL ALE AND ANI DAG DAL DAN DEL DEN DIE DIG DIN EAN ELD END GAD GAN GED GID GIE GIN IDE ILE IND ING LAD LAG LEA LED LEG
LID LIE LIG LIN NAD NAG NIL
AGED AGEN AGNI AIEL ANIL DALE DANE DANG DEAL DEAN DEIL DIAL DIAN DINE DING EGAD EGAL EILD ELAN GADE GAEL GAIN GALE GANE
GEAL GEAN GEIN GELD GENA GIDE GILD GILE GLAD GLEN IDEA IDLE INDE LADE LAID LAIN LAND LANE LANG LEAD LEAN LENA LEND LIAD LIED
LIEN LIGE LIND LINE LING NAID NAIL NALE NEAL NIDE NILE
AGEND AGILE AILED ALGID ALIEN ALIGN ALINE ANGEL ANGLE ANILE DEIGN DIGNE ELAIN ELAND GALEI GANIL GELID GLADE GLAND GLEAD
GLEAN GLIDE GNIDE IDEAL INGLE LADEN LADIN LIAGE LIANE LIDGE LIGAN LINED LINGA

ALDINE ANGLED DANGLE DANIEL DENIAL DINGLE ELDING ENGILD GAINED GENIAL GILDEN GLADEN GLIDEN LADING LINAGE NAILED
ADELING DEALING LEADING

Fig 11.

41

3 Letters: Find all 11 words.
4 Letters: Find all 15 words.
5 Letters: Find all 3 words.
6 Letters: Find all 5 words.
7 Letters: Find the 1 word.

A A C M L C I

AAM AIL AIM ALA CAL CAM LAC LAM LIM MAA MAC

ALMA AMIA AMIC CALI CALM CIMA CLAM ICAL LAIC LAMA LIMA MAIA MAIL MALA MICA

CLAIM LAMIA MALIC

ALCAIC CALAMI CAMAIL CICALA LAMAIC

ACCLAIM

Fig 14.

42

3 Letters: Find 20 out of 39 words.
4 Letters: Find 20 out of 60 words.
5 Letters: Find 20 out of 33 words.
6 Letters: Find all 16 words.
7 Letters: Find all 3 words.

E D G A L N I

AGE AID AIL ALE AND ANI DAG DAL DAN DEL DEN DIE DIG DIN EAN ELD END GAD GAN GED GID GIE GIN IDE ILE IND ING LAD LAG LEA LED LEG LID LIE LIG LIN NAD NAG NIL

AGED AGEN AGNI AIEL ANIL DALE DANE DANG DEAL DEAN DEIL DIAL DIAN DINE DING EGAD EGAL EILD ELAN GADE GAEL GAIN GALE GANE GEAL GEAN GEIN GELD GENA GIDE GILD GILE GLAD GLEN IDEA IDLE INDE LADE LAID LAIN LAND LANE LANG LEAD LEAN LENA LEND LIAD LIED LIEN LIGE LIND LINE LING NAID NAIL NALE NEAL NIDE NILE

AGEND AGILE AILED ALGID ALIEN ALIGN ALINE ANGEL ANGLE ANILE DEIGN DIGNE ELAIN ELAND GALEI GANIL GELID GLADE GLAND GLEAD GLEAN GLIDE GNIDE IDEAL INGLE LADEN LADIN LIAGE LIANE LIDGE LIGAN LINED LINGA

ALDINE ANGLED DANGLE DANIEL DENIAL DINGLE ELDING ENGILD GAINED GENIAL GILDEN GLADEN GLIDEN LADING LINAGE NAILED

ADELING DEALING LEADING

Fig 15.

FLOW CHART OF STEPS FOR PLAYING
WORD GAME OF SCRAMBLE STICKS

Providing each player with a writing instrument

Providing each player with a plurality of blank letter tiles

Providing a plurality of blank Word-Sticks of varying word length

Displaying a card from a plurality of cards with each card having a printed thereon a scrambled version of a word Each player forms as many permutated words form the displayed scrambled word Each player uses the writing instrument to write each permutated word on one of the blank Word-Sticks

Fig. 18.

SCRAMBLED WORD GAME

BACKGROUND OF THE INVENTION

The invention relates to word games and in particular to a scrambled word game utilizing a plurality of cards with each card having imprinted a scrambled version of a word and its word permutations.

The prior art is replete with various types of word forming and scrambled word games. Some scrambled word games allow as few as two or as many as an entire classroom of children to compete against one another.

U.S. Pat. No. 5,586,765 teaches a scrambled word game that utilizes a plurality of cards. Two or more players may play the scrambled word game. Each card has imprinted a plurality of words with a scrambled version of the word's letters next to each word. To begin a round of the scrambled game a player selects and presents the selected scrambled version of the word to the other player or players who then attempt to unscramble the letters to form the correct word within the given time limit. Points are awarded to the player who is the first to form a word. A player wins when his score reaches a pre-determined value. The method of playing a word scramble game for two or more players includes the steps of providing a plurality of cards forming a card set wherein each card has printed thereon a plurality of correctly spelled words opposite a scramble version of each such word, providing each player with paper and a writing instrument, providing a timing mechanism, a die, starting a round by each player drawing a card from the card set and positioning the card such that the words on the card are not in clear view of the other players, providing a mechanism for determining which player should be selected to choose and verbally present the scrambled letters to the other player or players, providing a mechanism for presenting the scrambled letters to the other player or players, activating the timing mechanism, each player as quickly as possible, writing on their own paper attempts to unscramble the given letters and form the correct word within the time period, a mechanism for player recognition when the player has formed a word from the given scrambled letters, providing point values to the player who provides the correct word from the scramble letters within the time period, providing point values to the player who first provides a word formed from the given scrambled letters and such word is not the same word provided from the given card selection, providing point values to the player who presented the scramble letters to the other player or players and which no player provided a correct unscramble version of the word. There are subsequent rounds that are played until one of the players wins by reaching a predetermined number of total points. The objective of this word scramble game is to be the first player to unscramble the given scramble letters and form the given word. Each player draws a card from the card set concealing the printed words from other players. Each player rolls the die and the player with the high die number will be the first "teacher". If the die roll results in a tie between players those players roll the die again until the "teacher" is determined. Once play has started the "teacher" role is past clockwise around the table to the other players. The teacher selects a word from his or her word card hoping that the other players will not be able to unscramble the letters and form the word. The teacher reads carefully the letters of the scrambled word in the order as printed on the card. The other players write down the scramble letters on their paper. When the teacher has completed reading the scramble letters the timing device is immediately activated.

The amount of time given to play each round should vary and correspond to the degree of difficulty. The degree of difficulty is increased by the use of cards with more letters per word. After the timing device is activated each player races his or her opponent attempting to be the first to unscramble the word correctly. When a player has unscrambled the word he or she gives a signal for recognition from the teacher. The signal for recognition may be the player raising his hand or verbally indicating that he has formed the word. The teacher acknowledges whether or not the given word is correct. If the player's given word is correct the player is awarded one point. If the player gives an incorrect word, that player loses a point and play continues until the correct answer is given or until the time period expires. If no players give a correct answer during the play period then the teacher is awarded a point. After each play period the teacher role is past clockwise to the next player. The new teacher again selects and presents the scrambled letters to the other players and activates the timing device. New cards are drawn from the card set after the player has used all word choices on the given card. Play is continued until a player reaches a predetermined score thereby winning the game. As an option, after a player forms a word that is not the correct word however the word is found in a dictionary containing the same letters and if such unscramble version is the first answer that is given by any player that player is awarded a point. Play is then continued for the remainder of the time period and if that same player or another player forms the correct word, that player also is awarded a point. Again, play is continued until a player reaches a predetermined score thereby winning the game.

U.S. Pat. No. 5,207,435 teaches a game for play between two or more players/teams with a deck of clue cards. Each clue card has a set of scrambled words imprinted thereon and an unsolved main word that is represented only by blank spaces and its first and possibly second letters to serve as a clue. The players/teams take turns drawing clue cards and attempting to unscramble the scrambled words and solve the main word with a set time period. The main word is a synonym or the name of a category of which the scrambled words are like synonyms or elements of the category, respectively. A second deck of cards having only one scrambled word thereon are provided to play bonus and challenge rounds. Points are awarded according to how many words are solved by each player/team and the first player/team to reach 100 points wins the game.

U.S. Pat. No. 5,195,753 teaches a knowledge game that is played with categories of scrambled words. The players unscramble the words. The first player that completes unscrambling in a category that is being played calls for a STOP. Points are allocated for correctly unscrambling every word as well as for unscrambling less than all the words. Rounds of play are repeated until a winning score is obtained. The method of playing a game includes defining one topic category which is intelligible and communicated to a player of the game, providing to a player a plurality of correct scrambled answer words each of which pertains to the topic category, unscrambling the words pertaining to the topic category, awarding a point value to the player for each correctly unscrambled word, playing successive rounds of play until a predetermined winning point total has been accrued.

The inventor incorporates the teachings of the above-cited patents into this specification.

SUMMARY OF THE INVENTION

The present invention is generally directed to a method of playing a scrambled word game that includes the step of providing a plurality of cards forming a card set.

In a first separate aspect of the present invention, each card has printed thereon a scrambled version of a word and a plurality of its permutated words correctly spelled.

In a second separate aspect of the present invention, the method of playing the scrambled word game also includes the steps of providing each player with a dry erase pen, a dry erase pad and a plurality of blank letter tiles.

In a third separate aspect of the present invention, a player starts a round by drawing a card from the card set and positioning the card such that the permutated words on the card are not in clear view of the players.

In a fourth separate aspect of the present invention, each player competes for and writes on one of the blank Word-Sticks with an erasable surface by correctly forming permutated words from the displayed scrambled word.

Other aspects and many of the attendant advantages will be more readily appreciated as the same becomes better understood by reference to the drawing and the following detailed description. The features of the present invention which are believed to be novel are set forth with particularity in the appended claims.

DESCRIPTION OF THE DRAWINGS

FIG. 10 is a front of a card with a scrambled word EDGALNI for use in the scrambled word game of FIG. 1.

FIG. 11 is a back of the card of FIG. 10 with permutated words of the scrambled word EDGALNI for use in the scrambled word game of FIG. 1.

FIG. 14 is a card with a scrambled word AACMLCI and permutated words of the scrambled word AACMLCI for use in the scrambled word game of FIG. 1.

FIG. 15 is a card with a scrambled word EDGALNI and permutated words of the scrambled word EDGALNI for use in the scrambled word game of FIG. 1.

FIG. 18 is a flow chart of the method of playing the scrambled word game of ScrambleSticks.

DESCRIPTION OF THE PREFERRED EMBODIMENT

Figure 1:
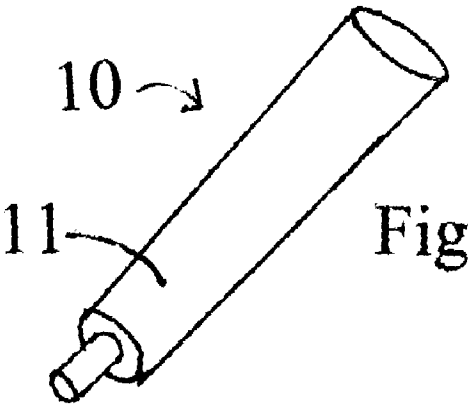
FIG. 1 is a perspective drawing of a dry erase pen for use in a scrambled word game according to the present invention.
Figure 2:
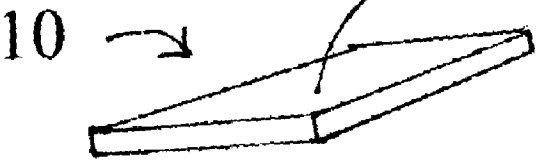
FIG. 2 is a perspective drawing of a blank letter tile for use in the scrambled word game of FIG. 1.

Referring to FIG. 1 in conjunction with FIG. 2 a scrambled word game 10 of ScrambleSticks includes a plurality of dry erase pens 11, a plurality of dry erase pads, a word box and a plurality of blank letter tiles 12. Each player receives one of the dry erase pens 11, one of the dry erase pads and seven blank letter tiles 12. The dry erase pen 11 may be of any one of a plurality of colors.

Figure 3:
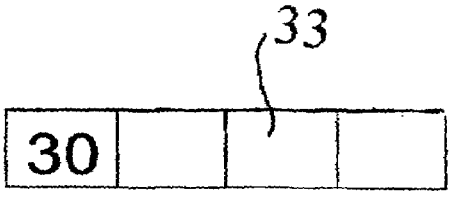
FIG. 3 is a three-letter Word-Stick for use in the scrambled word game of FIG. 1.
Figure 4:
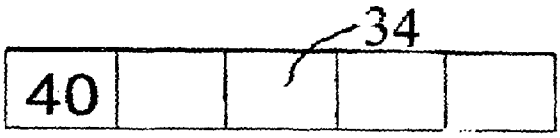
FIG. 4 is a four-letter Word-Stick for use in the scrambled word game of FIG. 1.
Figure 5:
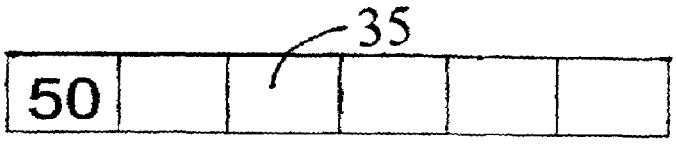
FIG. 5 is a five-letter Word-Stick for use in the scrambled word game of FIG. 1.
Figure 6:
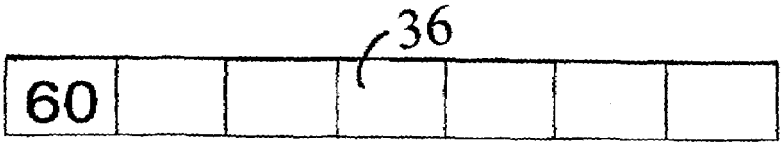
FIG. 6 is a six-letter Word-Stick for use in the scrambled word game of FIG. 1.
Figure 7:
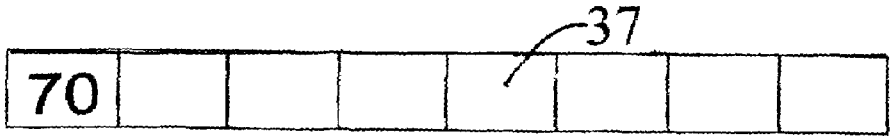
FIG. 7 is a seven-letter Word-Stick for use in the scrambled word game of FIG. 1.

Referring to FIG. 3 in conjunction with FIG. 4, FIG. 5, FIG. 6 and FIG. 7 the scrambled word game 10 of Scramble-Sticks also include a plurality of three letter Word-Sticks 33 with a point value of 30, a plurality of four letter Word-Sticks 34 with a point value of forty, a plurality of five letter Word-Sticks 35 with a point value of fifty, a plurality of six letter Word-Sticks 36 with a point value of sixty and a plurality of seven letter Word-Sticks 37 with a point value of seventy.

Figure 8:
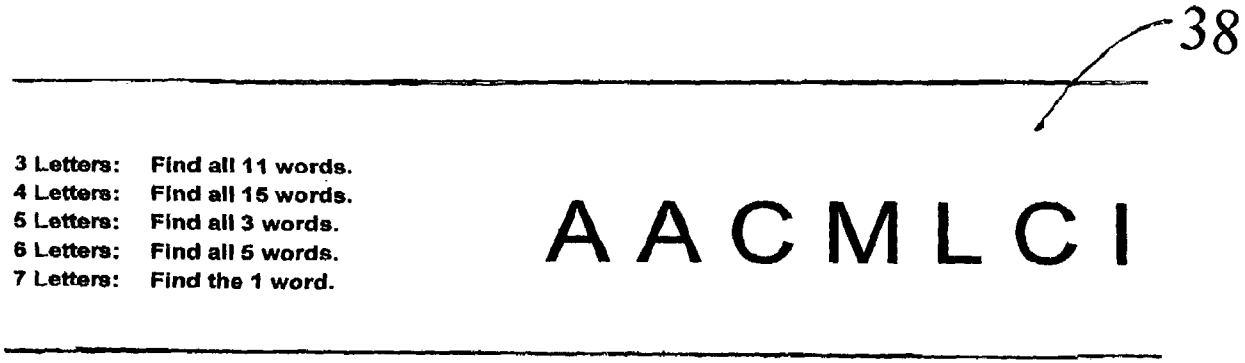
FIG. 8 is a front of a card with a scrambled word AACMLCI for use in the scrambled word game of FIG. 1.
Figure 9:
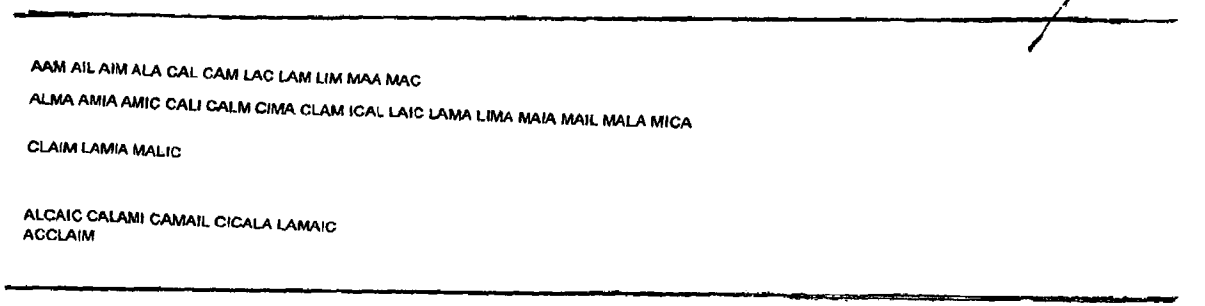
FIG. 9 is a back of the card of FIG. 8 with permutated words of the scrambled word AACMLCI for use in the scrambled word game of FIG. 1.

Referring to FIG. 8 in conjunction with FIG. 9 a card 38 has a scrambled version of the word ACCLAIM on its front and a plurality of its permutations of all three, four, five, six and seven letter words on its back.

Referring to FIG. 10 in conjunction with FIG. 11 a card 39 has a scrambled version of the word LEADING on its front and a plurality of its permutations of all three, four, five, six and seven letter words on its back.

Figure 12:
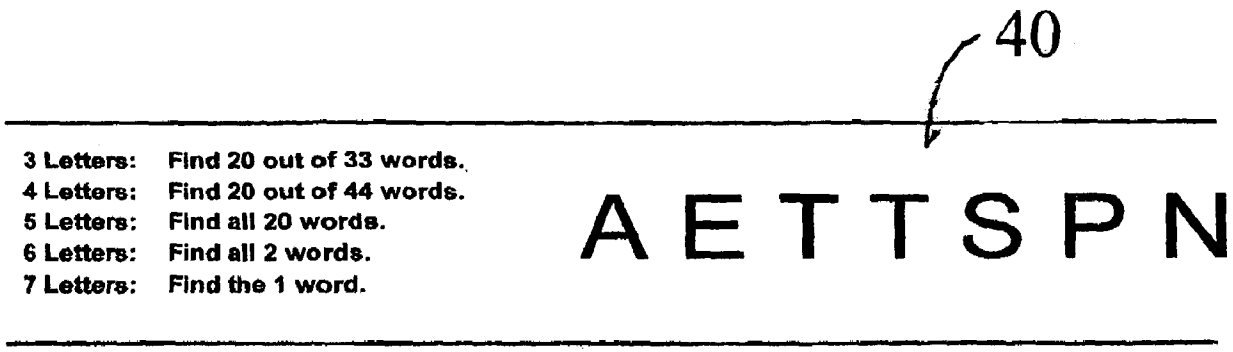
FIG. 12 is a front of a card with a scrambled word AETTSPN for use in the scrambled word game of FIG. 1.
Figure 13:
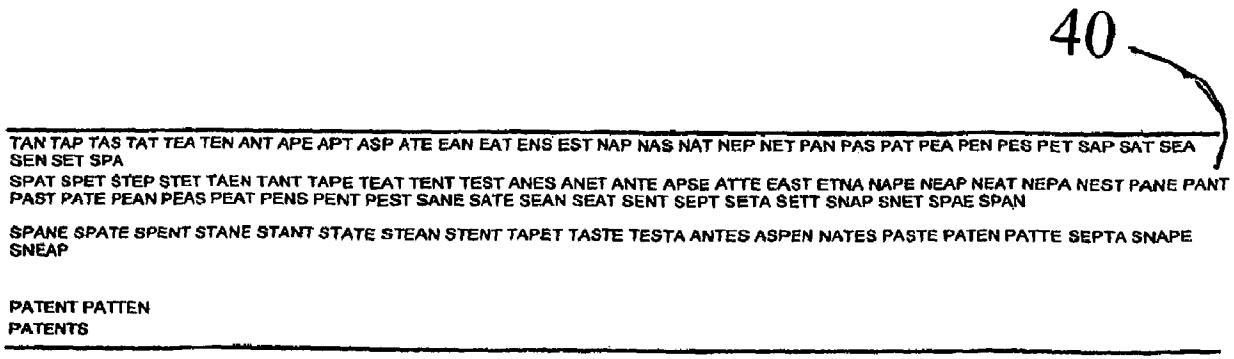
FIG. 13 is a back of the card of FIG. 12 with permutated words of the scrambled word AETTSPN for use in the scrambled word game of FIG. 1.

Referring to FIG. 12 in conjunction with FIG. 13 a card 40 has a scrambled version of the word PATENTS on its front and a plurality of its permutations of all three, four, five, six and seven letter words on its back.

Referring to FIG. 14 a card 41 has a scrambled version of the word ACCLAIM and a plurality of its permutations of all three, four, five, six and seven letter words.

Referring to FIG. 15 a card 42 has a scrambled version of the word LEADING and its permutations of all three, four, five, six and seven letter words.

Figure 16:
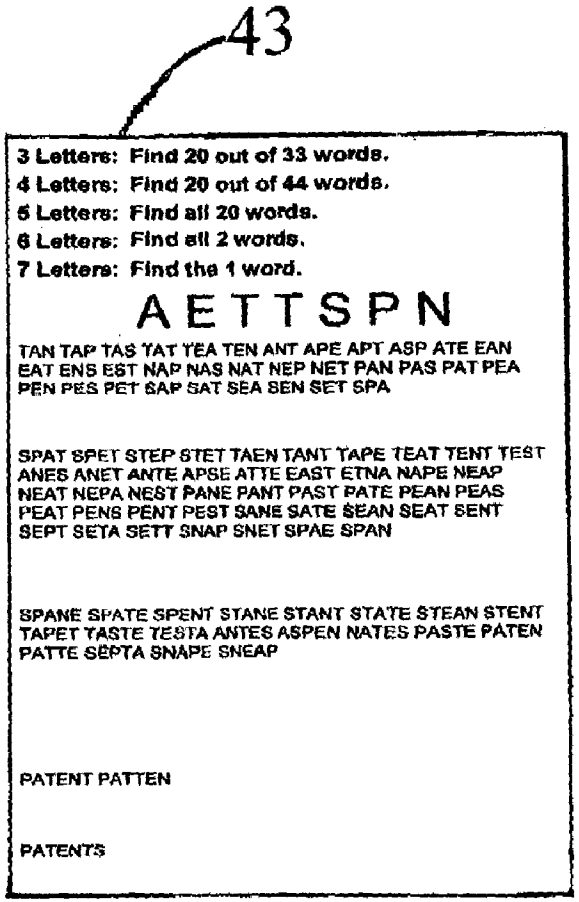
FIG. 16 is a card with a scrambled word AETTSPN and permutated words of the scrambled word AETTSPN for use in the scrambled word game of FIG. 1.

Referring to FIG. 16 a card 43 has a scrambled version of the word PATENTS and its permutations of all three, four, five, six and seven letter words.

Figure 17:
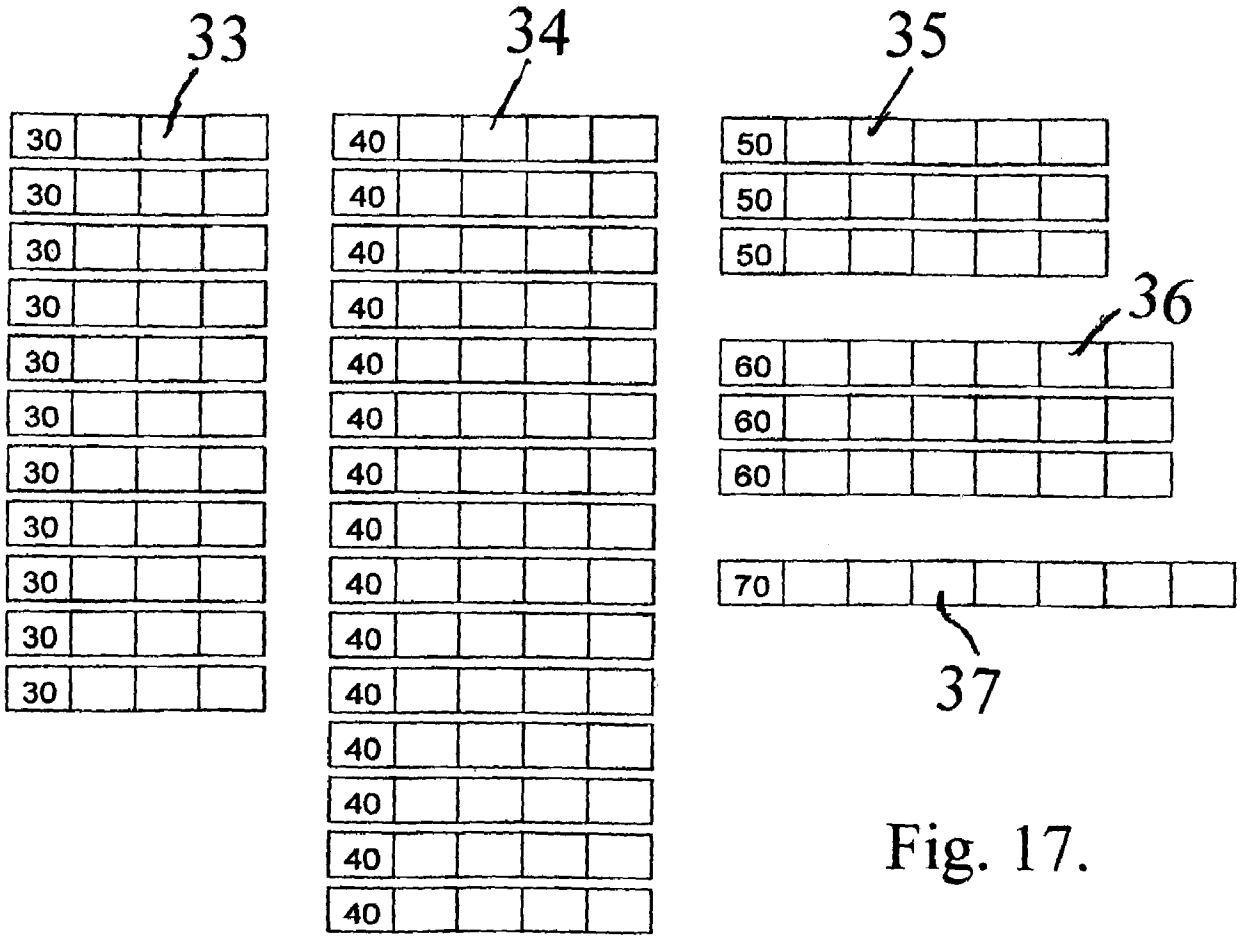
FIG. 17 is a layout of all of the Word-Sticks for the scrambled word AACMLCI and permutated words of the scrambled word AACMLCI for use in the scrambled word game of FIG. 1.

Referring to FIG. 17 a layout of all of the Word-Sticks for the scrambled word AACMLCI.

In the scramble word game 10 of ScrambleSticks the object for the players is to compete for high score by creating as many words as possible from a seven-letter word scramble. A plurality of rounds of ScrambleSticks makes up a game.

Referring to FIG. 18 a flow chart demonstrates a method of playing the scrambled word game 10 of Scramble Sticks by at least two players. The method consists of the steps of providing each player with a writing instrument, providing each player with a plurality of blank letter tiles and providing a plurality of blank Word-Sticks of varying word length. The method also consists of the steps of displaying a card from a plurality of cards with each card having printed thereon a scrambled version of a word and of each player forming as many permutated words from the displayed scrambled word and using the writing instrument to write each of the permutated words on one of the blank Word-Sticks.

A method of playing the scrambled word game 10 of ScrambleSticks for two or more players includes the steps of providing a plurality of cards forming a card set. Each card has printed thereon a scrambled version of a word and a plurality of permutated words correctly spelled. The method of playing the scrambled word game 10 also includes the steps of providing each player with a dry erase pen 11, a dry erase pad and seven blank letter tiles 12. A player starts a round by drawing a card from the card set and positioning the card such that the permutated words on the card are not in clear view of all of the players. Each player competes for and writes on the blank Word-Sticks by correctly forming permutated words from the displayed scrambled word.

In order to set up a round of the scramble word game 10 of ScrambleSticks each player is distributed seven blank letter tiles 12, one dry erase pen 11 and one dry erase pad. The top of the word box is removed. A selected payer may choose to shuffle the cards in the word box. Once they are shuffled, the front first card in the word box becomes the starting card and remains in the word box until the end of the game. The top section of the card reveals how many words can be formed from the scrambled letters that is about to be revealed. This is called the word distribution list. Word-Sticks are grouped in columns by word length and are placed in the center of the players corresponding to the word distribution list. For example, if the word distribution list says, "Three Letters: Find 10 out of 30 words." Then take ten, three length Word-Sticks 33 and create a three word column in the center of the players. For "Four Letters: Find all 15 words", take fifteen, four length Word-Sticks 34 and create a four word column in the center of the players. The players continue this process for the five letter, six letter and seven letter word lengths on the distribution list. Next, the selected player slowly pulls out the word card revealing only the scrambled word to the all of the players. The rest of the card with the permutated words is left hidden behind the bottom portion of the word box until the end of the round. Each player then takes his dry erase pen and writes down the revealed letters on his blank letter tiles. Once each player has written down the revealed letters, a seven minute timer is started and round one of ScrambleSticks begins.

During the playing of the game there are no turns. Each player uses his tiles to help him find words as fast as possible that other players have not found yet. Once a player has found a word, the player grabs a Word-Stick from the bottom of the column corresponding to the length of his found word and writes the word on the Word-Stick using his dry erase pen 11 and places it back in front of the other players on top of the correct word length column by announcing the word. For example, if a player finds the word CAT then the player grabs a three letter length Word-Stick 33 at the bottom of the three letter length word column and writes the word CAT on the three letter length Word-Stick 33 and places it back in the center of the players on top of the three letter length word column and says, "cat." Players have a choice of telling the player whether they think the word is real or has already been played. However, once a player has let go of a Word-Stick by placing it back in the center then the word has been played and cannot be taken back and erased. At the end of the game, the number of illegal words played reduces the score of a player. Once a player grabs a blank Word-Stick he must form a word or immediately put back the blank Word-Stick. Play continues until all Word-Sticks have been used or time has run out.

The scoring of ScrambleSticks is done at the end of a round. Each player groups together his Word-Sticks and then sums together all the Word-Stick values. Any contested words found to be illegal are subtracted out. Players check out contested word by using the list on either the word card or a dictionary. Usually, there are three rounds in one scrambled word game 10 of ScrambleSticks. To begin another round, players must wipe clean all of the letter tiles 12 and the Word-Sticks and move the last used card to the back of the word box, thus revealing the next card.

From the foregoing it can be seen that a scrambled word game has been described. Accordingly it is intended that the foregoing disclosure and drawings shall be considered only as an illustration of the present invention.

What is claimed is:

1. A method of playing a scrambled word game by at least two players comprising the steps of:

a. providing a plurality of writing instruments wherein each of the players receives one of said writing instruments;

b. providing each player with a plurality of blank letter tiles;

c. providing a plurality of blank Word-Sticks of varying word length; and d. displaying a card from a plurality of cards wherein each of said cards has printed thereon a scrambled version of a word and wherein each player forms as many permutated words from the displayed scrambled word and uses said writing instrument to write each of said permutated words on one of said blank Word-Sticks.

* * * * *